US008272152B2

(12) United States Patent
Fernandez

(10) Patent No.: US 8,272,152 B2
(45) Date of Patent: Sep. 25, 2012

(54) STEAMER

(75) Inventor: Juan Fernandez, Towaco, NJ (US)

(73) Assignee: Products of Tomorrow, Inc., Towaco, NJ (US)

( * ) Notice: Subject to any disclaimer, the term of this patent is extended or adjusted under 35 U.S.C. 154(b) by 367 days.

(21) Appl. No.: 12/584,680

(22) Filed: Sep. 10, 2009

(65) Prior Publication Data

US 2010/0058623 A1 Mar. 11, 2010

Related U.S. Application Data

(60) Provisional application No. 61/096,307, filed on Sep. 11, 2008.

(51) Int. Cl.
*D06F 75/30* (2006.01)
*D06C 7/00* (2006.01)

(52) U.S. Cl. ..... 38/77.9; 68/222

(58) Field of Classification Search ..... 68/222, 68/5 C; 38/93–98, 77.9, 79, 100; 223/51; 392/394, 399
See application file for complete search history.

(56) References Cited

U.S. PATENT DOCUMENTS 3,074,192 A 6/1962 Smith
3,497,117 A 3/1969 Rebiscoul
3,646,317 A * 2/1972 Osrow ..... 392/337
3,690,024 A 9/1972 Osrow
3,733,723 A * 5/1973 Takakuwa et al. ..... 38/69
3,752,373 A * 8/1973 Smith ..... 223/51
3,968,581 A 7/1976 Tsunoda
4,219,724 A * 8/1980 Allvin ..... 219/243
4,817,309 A 4/1989 Frank
4,922,637 A 5/1990 Davidson
4,953,300 A 9/1990 Davidson
4,955,152 A 9/1990 Davidson
5,010,905 A * 4/1991 Snyder et al. ..... 132/272
5,181,333 A 1/1993 Gilbert
5,609,047 A * 3/1997 Hellman et al. ..... 68/222
5,687,278 A * 11/1997 Turner ..... 392/406
5,692,315 A * 12/1997 Sham ..... 34/99
5,815,961 A * 10/1998 Estes et al. ..... 38/14
6,061,935 A 5/2000 Lee
6,581,809 B1 6/2003 McElhinney
6,986,217 B2 1/2006 Leung
7,000,340 B1 2/2006 Uchikoshi
7,188,442 B2 3/2007 Fernandez
2010/0018084 A1* 1/2010 Segrete ..... 38/71

* cited by examiner

*Primary Examiner* — Ismael Izaguirre
(74) *Attorney, Agent, or Firm* — Gearhart Law, LLC

(57) ABSTRACT

The invention is a steamer head, which includes a steamer body having a front face having at least one steam hole, the steam hole being in fluid communication with a steam chamber; and a crease panel assembly movably connected to the steamer body, the crease panel having a crease panel face, wherein the crease panel face has at least a portion in substantially parallel orientation to the front face.

6 Claims, 4 Drawing Sheets

STEAMER

CLAIM OF PRIORITY

This application claims priority to U.S. Ser. No. 61/096,307 filed Sep. 11, 2008, the contents of which are fully incorporated herein by reference.

FIELD OF THE INVENTION

The present invention relates to devices for clothing care, in particular to clothing steamers.

BACKGROUND OF THE INVENTION

Portable hand held devices for applying steam are particularly useful in removing wrinkles and improving the appearance of hanging garments, draperies, upholstery, and other items made of fabric. When traveling, these devices may be especially effective for freshening clothes that have been packed in luggage. They are also useful for improving the appearance of hanging draperies without removing them, straightening and flattening upholstery, opening seams, and, generally, for smoothing fabric during sewing operations. In all of these applications, it is not only important to apply steam to the fabric, but to do so in a safe and easy manner. It is also important to be able to apply a desired amount of steam to a particular portion of the fabric being treated.

An additional feature that is desirable, but not typically available in a steamer, is a function that allows the user to put a crease in a piece of clothing. For instance a sharp, clean crease down the front of a pair of men's suit pants enhances the perception that the user is a professional, which is particularly important for a business presentation or meeting. The present invention incorporates a creaser function with the steamer to enhance the device's versatility and usefulness.

There are several factors that make the steaming operation difficult. An appliance that is large may occupy a significant amount of space rendering it unsuitable for use when traveling. An appliance that is bulky and heavy may be difficult to manipulate and thus inhibit applying the proper amount of steam for the time required to remove wrinkles. In addition, a bulky appliance may make it difficult to operate the controls.

Another factor is the quantity of water the device will hold. If the device is made compact in order to be portable, it will have to be refilled, often more than once, to steam one garment. The present invention overcomes this difficulty in that it has a collapsible water reservoir. This enables the steamer to be collapsed into a compact unit for storage or traveling, and then expanded to a size that allows the user to fill it with enough water to have a reasonably lengthy window of steaming time before the reservoir needs to be refilled.

An appliance that does not accommodate different voltages encountered in different countries may be inconvenient. One embodiment of the present invention allows for world-wide use by employing a transformer or incorporated circuitry that adapts to either 110-120 volt input or 220-240 volt input.

Attempts that have been made in the prior art to address the issues described above are listed below.

U.S. Pat. No. 6,986,217 teaches a hand held appliance for use in applying steam to a garment or other item made of fabric which includes a pump, a boiler and a switch. Power is applied through the switch to the pump. The pump pumps water from the water tank to the boiler. The water is converted to steam in the boiler and is expelled from the appliance through a set of nozzles. The appliance may include optional attachments for performing other operations on garments or fabric, for example, applying pressure, brushing, scrubbing or removing lint.

U.S. Pat. No. 4,817,309 teaches a hand-held steam brush, consisting of a support plate with steam holes which forms an outer wall of the hand-held steam brush. A pressure plate with steam exit holes is releasably secured to the support plate. The pressure plate, guided by hinged spacers, is movable towards the support plate counter to the pressure of a spring and can be fixedly connected to the support plate by means of a pressure plate locking device.

U.S. Pat. No. 3,074,192 teaches a creasing iron having a spring-loaded vertically-separable false bottom actuated by finger control. The material to be creased is ironed between the two bottoms.

U.S. Pat. No. 3,497,117 teaches an apparatus for ironing trousers wherein air and steam are fed through a hollow support onto the trouser's fabric. The trousers are fitted through the fork between two upright channels, the cross-sections of which are in the shape of isosceles triangles facing each other. The steam passes through the channels in succession and possibly also through a medial connection between the hollow support and the location of the inside of the trousers when suspended through their creases between the upright channels.

U.S. Pat. No. 7,188,442 teaches a handheld iron for pressing or creasing an article of fabric without the use of an ironing board. The handheld iron having a housing, a platform, and an actuator for displacing the platform with respect to the housing. The housing further includes a heating surface and the platform further includes a platform surface. The heating surface and the platform surface are in substantially parallel planes at all times, including when the platform is displaced with respect to the housing.

U.S. Pat. No. 7,000,340 teaches a shirt press which is formed to comprise a collar iron buck on which a collar is mounted while being expanded and a press iron for depressing against the buck. The upper surface of the buck corresponds to a central part of the collar and is notched in an inverse triangle shape. The right and left positions correspond to the collar ends and are placeable on left and right buck portions into a horizontal surface. The collar is mounted on the buck and a receiving plate, which is arranged above the upper-notched surface with the height thereof being set to the left and right buck portions, supports a central portion. When the press iron is lowered the ends of the collar are pressed and pulled out such that the iron surface of the press is formed into a flat surface.

U.S. Pat. No. 6,581,809 teaches an iron, press and/or steaming device for hats. In particular, it is directed at steaming or pressing baseball caps. The invention comprises two semi-spherical halves that are attached by a handle. The handle can be squeezed and made to collapse to make the two flat inner faces of the semi-spherical halves press together. Once pressed together, the two semi-spheres should look like a single sphere. Located on both the rounded outer surfaces and the flat inner surfaces of both semi-spheres are numerous steam vents. By squeezing the two halves together, the user can apply the flat inner surfaces of the semi-spheres as a steam press. This is particularly useful for pressing the bill/brim of a baseball cap or other hat. The spherical outer surface is useful for placing inside a hat for steaming. In a first embodiment the sphere in its fully expanded state is approximately half the diameter of an ordinary hat. A user when steaming the inside of a hat must apply tension manually to de-wrinkle the hat while steaming. In an alternate embodiment, the expanding sphere (from when the handle is released) would fill the inside of the hat, pulling it taught. The inner workings, which generate the steam, would be similar to traditional steamers, including water reservoirs and the like.

U.S. Pat. No. 6,061,935 teaches a dual appliance for steam treating garments, having a central reservoir and an electrical water pump to supply water to a steamer or a steam iron. Separate braided flexible cables supply water and power to the steamer and to the steam iron, to which the respective cables are respectively permanently connected. Plugs are provided at the ends of the cables for connection to a socket.

U.S. Pat. No. 5,181,333 teaches a height adjustable pants finishing device that includes a pair of topping bucks positioned in the top portion of a pair of pants to be finished. Waist clamps hold the pants in the desired orientation; then, pressing plates engage pleats to hold the pleats for pressing. Additional pressing plates engage the top portion of the pants for high quality finishing of the top of the pants. The cuffs of the pants are clamped together, and steam is injected into the pants for finishing. After steaming, heated air is passed through the pants to set the creases.

U.S. Pat. Nos. 4,955,152, 4,953,300, and 4,922,637 teach a steam iron press which employs first and second members and a lever mechanism connected to the second member and when manually actuated by an operator causing the second member to be moved to any position between a position of maximum separation and a position of engagement with respect to the first member. The second member receives water and converts the water into steam which is expelled through openings therein. A pump connected between the second member and a water reservoir feeds water to the second member. A cam mechanism is connected between the lever mechanism and the pump to only actuate the pump during a predetermined interval between the instant of time T1 at which the lever mechanism has initiated movement of the second member toward the first member and the instant of time T2 at which an article to be pressed is squeezed between the two surfaces.

U.S. Pat. No. 3,968,581 teaches a steam presser for finishing garments, etc. The presser comprises a steam-spouting press table, a steam-generating chamber of the heat-plate type disposed under the steam-spouting press table, compressive water-feed valve means mounted on the steam-generating chamber, and waste steam suction means disposed beside the steam-generating chamber. In operation, a necessary amount of water is fed into the steam-generating chamber by means of the compressive water-feed valve means against the steam pressure in the chamber. Steam produced in the steam-generating chamber is spouted out through the mattress of the press table to effect the finish of the materials pressed between the mattress and the cover plate of the press table. The steam suction means further enhances the finishing effect by sucking away the steam permeated into the materials.

U.S. Pat. No. 3,690,024 teaches a lightweight portable electric hand steamer with a special sole plate having a prow that is uniquely shaped to spread the concealed short edges at the rear of a seam joining two plies of fabric which are to be pressed into planarity. The prow includes a leading beak for initiating separation of the short rear edges. Behind the prow the sole plate is provided with a flat pressing surface. Steam issues through the pressing surface to impinge upon the fabric plies being pressed as well as upon the short rear edges so as to render them pliant for pressing. The entire sole plate, but particularly the flat pressing surface, is formed of a synthetic plastic whereby the pressing surface has a low specific heat and a low coefficient of heat conductivity so that the pressing surface is relatively cool in comparison with a conventional metal pressing surface. This has the unusual effect of preventing the outline of the steamed-flat short rear edges from showing through the planar portions of the plies after the pressing/steaming operation has been completed.

None of the art listed above describes the present invention. The present invention combines a steamer with a creaser and, in one embodiment, with a collapsible feature. The mode of operation of the creaser with the steamer is novel, as described below. The collapsible feature allows the user to have a compact steamer to transport or store, but also to have the added convenience of a larger water reservoir than is available in portable steamers currently on the market. This saves time and avoids inconvenience by eliminating the need for water refills during the steaming or creasing of a garment.

SUMMARY OF THE INVENTION

The invention is a steamer head, which includes a steamer body having a front face having at least one steam hole, the steam hole being in fluid communication with a steam chamber; and a crease panel assembly movably connected to the steamer body, the crease panel having a crease panel face, wherein the crease panel face has at least a portion in substantially parallel orientation to the front face.

The preferred embodiment of this invention is one in which the steamer head (the term steamer head being used to describe a head and/or a nozzle) is detachable from the main body. This steamer head has an articulated creasing plate which when not in use rests flat against the face of the steamer head (or steam outlet face) and allows the steamer head to function normally to steam clothes. When precise creasing is desired the creasing plate is engaged and a separation is created between the creasing plate and the steamer head (or steam outlet face) into which the garment to be creased is inserted. The creasing plate is always under tension/load in its normal resting position and this same tension when activated is used to create the pressure necessary for the creasing function to be carried out. This allows the user to release the creasing plate activation mechanism during the actual creasing function for better control of the unit and less fatigue and strain on the hand/fingers from having to hold or press a mechanism to maintain the pressure needed to create a proper crease.

The main steamer body that receives the steamer head attachment is comprised of at least two or more interconnected rigid structures/sections which can nest one inside the other for storage. These rigid sections provide the frame for the main steamer body and also can insulate the user from the heat generated by the steam generating process in the base. The water holding chamber/tank is comprised of at least one section of flexible material which allows it to expand or contract as needed to increase or decrease the water capacity in the tank and for storage purposes. This flexible chamber/compartment is sealed and isolates the heater and water. The materials for this compartment must be resilient enough to withstand cycles of high temperature, moisture and corrosion, as well as compression/expansion of its dimensions under normal use.

It is an object of the invention to provide a clothing steamer and creaser in one product.

It is an object of the invention to provide an easily portable steamer for pressing clothing.

It is an object of the invention to provide a steamer with a creaser function that is easy to use.

It is an object of the invention to provide a combined steamer and creaser that is easy to store.

It is an object of the invention to provide a combined steamer and creaser that can be used world-wide.

DESCRIPTION OF THE PREFERRED EMBODIMENTS

Figure 1:
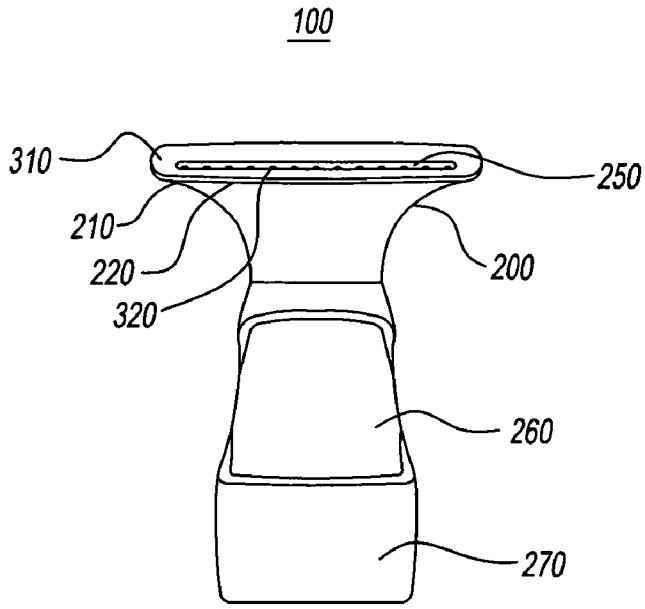
FIG. 1 is a front view of the invention.

FIG. 1 shows a front view of the steamer 100, with steamer head 200, steamer body 210, steamer body front face 220, steam hole 250, steam chamber 260, steam chamber housing 270, crease panel 310, crease panel face 320 and crease panel steam hole 390.

The steamer 100 may be any suitable size, and may be manufactured in a variety of sizes. For instance, a larger steamer may be desired by some while others prefer a smaller sized steamer. Preferred dimensions are 2-20" in length by 0.25-12" high for the steamer body; the size of the steamer body may be determined in part by the size of the steam chamber, as the steam chamber must contain enough capacity to allow a sufficient flow of steam for a sufficient period during use.

Alternately, one embodiment may include a steam chamber that contains a portal for connecting a hose which in turn connects to a sink faucet. In this configuration, the steamer may be refilled as necessary from the spigot without disassembling the steamer. This embodiment avoids the possibility of the user being burned when he must refill the steam chamber, and the ease of refill allows the steam chamber to be smaller in relation to the steamer body than in the first embodiment.

Both the steamer body front face 220, steam hole 250 and crease panel 310 face may be made of metal, plastics, PVC or any other material so as to allow for even conduction of heat during the steaming and creasing activity. Such materials include but are not limited to stainless steel, or any metal, or coated metals. Steam produced by the steamer 100 passes through the steamer hole or holes 250 which the user may press against or direct toward the garment or fabric requiring wrinkle removal or refreshing.

Currently available steamers lack the creasing feature of the present invention. This feature facilitates use of the steamer not only for making creases but also for removing wrinkles by holding the garment of fabric to be pressed taut. In any steamer, the steamer head must be pressed against the garment in order for the wrinkles to be removed while at the same time the garment needs to be held taut for the most effective garment steaming technique and results. If the user does not press up against the garment with some flat surface and rub or press the garment surface while the steam is flowing, the wrinkles are more difficult to remove. In order to press against the garment it must be secured and held down somehow. The present invention solves this problem because the user can steam traditionally as described above and can use the crease panel assembly (shown in FIG. 2) to hold the fabric taut while steaming.

The entire steamer and component parts may be made from any material, including but not limited to: plastics and resins including but not limited to ABS, Polycarbonate, Noryl™, PVC, Polystyrene, ABS/PVC, PVC/Acrylic, Polysulfone, Acrylic, Polyethylene, Kydex™, PETG; glass, including but not limited to fiberglass, borosilicate, or quartz; wood; metals, including but not limited to iron, tin, aluminum, copper; rubbers including but not limited to natural rubber, SBR, Isoprene rubber, Butadiene rubber, silicone rubber, and Chloroprene rubber; or any combinations or composites of these materials or other materials and new materials that may be manufactured in the future. The parts to the steamer and its various parts and components may be manufactured from identical or different components, and the steamer body may be manufactured using differing components in different parts.

A continuous or non-continuous coating on the metal or conducting material on the steamer body front face 220, steam hole 250 and crease panel 310 face may be added to ease the use of the device during creasing. Such coatings include, but are not limited to Teflon, silicone, and nylon.

With the faceplate 310 in the closed orientation, an alternate embodiment (illustrated in FIG. 6) provides for one or more crease panel rollers 380 which allow the user to easily roll the fabric between the crease panel 310 and the steamer body front face 220. The steamer head 200 may have no rollers. The steamer body head may have one or more crease panel rollers 380. The rotating or rolling device may consist of the crease panel or may be a small portion of the crease panel, and may also be made of any suitable material, including but not limited to, conducting materials, or covered, entirely or partially, with non-stick coatings, as described herein. Depending on the orientation of the crease panel roller(s) 380, the rollers may facilitate the glide of the fabric through the device, for example when one or more rollers are situated horizontally with the travel direction of the fabric. Also, one or more rollers may be situated in other orientations to the fabric, such as perpendicularly. The crease panel 310 and or the steamer body face 220 may be flat, v-shaped or contain designs or crimps of various shapes allowing the user to make straight or other shaped indentations or creases on fabrics. The steamer body face 220 and or the crease panel face 320 may be removable so that creasing points may be varied by the user changing to a different shape.

The steamer head 200 may have a crease panel 310 that has at least one crease panel steam hole 390 that is in fluid connection with a steam hole 250, so that steam passes through the crease panel to allow usage as a traditional steamer.

The crease panel face 320 is flat with a crease point. The crease panel face 320 is in a V shape or angled with a creasing point in the center for use along the horizontal direction of the garment. The crease point can be located anywhere on the crease panel face 320, centered or off center, depending on the particular use and where the user wishes to place a crease. For example, placing the creasing point on one side horizontally across the crease panel face 320 allows for use along the vertical direction of the garment. In another embodiment the creasing point is placed vertically on the crease panel face allowing for use along the horizontal direction of the garment. In all embodiments, the user may slide the fabric either horizontally or vertically.

Also, the crease panel face is removable so that creasing points may vary. In still another embodiment, the steamer 100 is equipped with a rotating steamer head 200, which allows the user to quickly change the orientation of the crease point. In addition, the steamer head may rotate 90 degrees. Further, the crease plate and steamer head has one or more holes to allow for the passage of steam.

A crease point is a raised line or a rib traveling across the crease panel 310 and crease panel face. This is simply a raised area parallel to the creasing head/plate which is used to remove the wrinkles when used in a traditional steamer manner. As explained earlier, in order to actually remove wrinkles the garment must be held taut while the steam makes contact with the garment and also while some edge is used to "iron" the wrinkles away. Steamers generally have an edge used to create this "ironing" action and to remove wrinkles. This edge can be the upper edge of the creasing head/plate or the lower edge. In one particular embodiment a raised bump or ridge right on the front face of the creasing head/plate may be added so as to form this needed edge for the purposes of removing wrinkles under normal steaming action.

Figure 2:
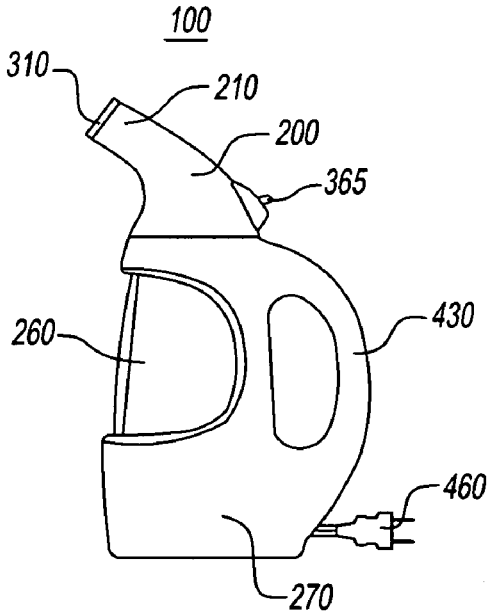
FIG. 2 is side of the invention.
Figure 2A:
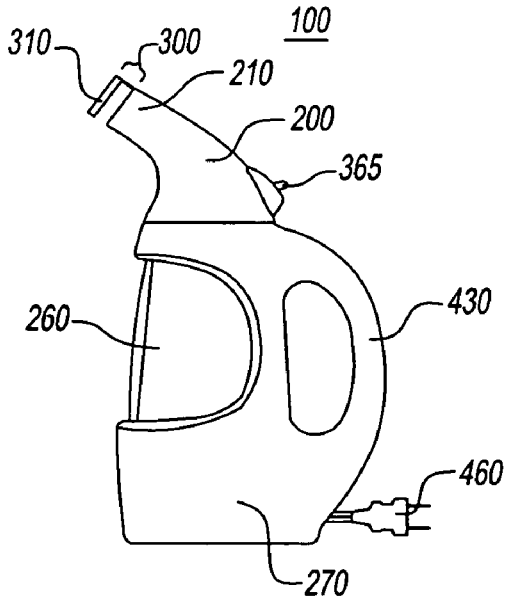

FIG. 2 shows a side view of the steamer 100; FIG. 2 has two parts, FIG. 2 and FIG. 2*a*. FIG. 2 shows the crease panel assembly 300 in its closed position, and FIG. 2*a* shows crease panel assembly 300 in its open position.

Both show steamer 100, steamer head 200, steamer body 210, steam chamber 260, steam chamber housing 270, crease panel 310, crease panel activation means switch 365, handle 430, and power cord 460. Water is stored in the steam chamber 260 which is encased in the steam chamber housing. Steam produced in the steam chamber 260 moves through the steamer body 210 and out the steamer head 200. The steamer body may have one or more holes and may be in fluid communication with the steam chamber.

The user may utilize the crease panel activation means switch 365, which in turn, allows the crease panel 310 to separate from the steamer body front face 220 thus allowing the user to place fabric in this opening. The crease panel assembly 300 is moved with a crease panel activation means switch 365. The crease panel activation means 360 contains a spring which brings the steamer body front face 220 in contact with the crease panel face 320. The crease panel activation means switch 365 may be utilized to close the distance between the crease panel 310 and the steamer body face 220, so that the fabric lies between the crease panel face 320 and the steamer body face 220 to allow the user to create a crease or crimp in said fabric. The crease panel activation means switch 365, allows for this operation by the user and may be made of any of the materials described herein.

The crease panel assembly 300 may be moveably connected to the steamer body. The crease panel 310 also contains a crease panel face 320 with at least a portion of the crease panel face being in substantial parallel orientation to the steam body front face 220. The steamer head 200 may have one or more holes to allow for the passage of steam. The steamer head 200 may also have a crease panel assembly that is moveably connected to the steamer body 210.

In one embodiment, the crease panel activation means switch 365, may be connected to a spring loaded device which permits opening and closing of the steamer body front face 220 and/or the crease panel face 320. In another embodiment, the crease activation switch activates a series of cogs connected to the steamer body front face and/or the crease panel face 320 which allow one or both to be placed in various orientations by the user.

In another embodiment, the crease panel assembly 300, the crease panel 310, the crease panel face 320 may together or separately be connected to the steamer head 200 in such a manner in that the crease panel 310 rotates. The crease panel 310 may also flip out and rotate down. In another embodiment the crease panel assembly 300, the crease panel 310, and the crease panel face 320 may together or separately be connected to the steamer head 200 in such a manner in that it flips out and rotates down 270 degrees. In another embodiment the crease panel assembly 300, the crease panel 310, and the crease panel face 320 may together or separately be connected to the steamer head 200 by a hinged mechanism. In another embodiment the crease panel assembly 300, the crease panel 310, and the crease panel face 320 may together or separately be connected to the steamer head 200 by a roller mechanism. The steamer body front face length 230 and the steamer body front face width may be the same size as the crease panel face length 330 and the crease panel face width 340. The steamer body front face length 230 and the steamer body front face width may be a different size from the crease panel face length 330 and the crease panel face width 340.

The steamer head 200 may be one continuous piece. In other embodiments, it may be fixed or rotated so as to permit compact storage of the steamer 100, or orientation preferred or called for by the user, or depending on the application. For example, an angled orientation may be preferred for steaming or freshening drapes or curtains while they are still connected vertically to their rods. The steamer head 200 may be disposed on the steamer 100.

The steamer head 200 may attach to a collapsible steamer 100. The steamer head 200 and/or steamer body 210 may be retractable into the steam chamber housing 270, to ease in portability and storability. The steamer head 200 may alternately be constructed in a wing-like manner which extends and folds also permitting for portability and storage.

Both the steamer head abutment 205 and or the steamer body front face 220 and the crease panel face 320, when touching, contain one or more steam holes 250 which allow for the continuous flow of steam from steam chamber 250. In one embodiment, both the steamer head abutment 205 and or the steamer body front face 220 and the crease panel face 320 are the same dimensions, but their dimensions may also all be varied from one another. In one embodiment, the steamer head abutment 205 and/or the steamer body front face 220 and the crease panel face 320 are different shapes. In another embodiment, the steamer head abutment 20 and/or the steamer body front face 220 and the crease panel face 320 are the same or substantially similar shapes.

The steamer head 200, steamer body 210, steamer chamber 260, crease panel activation means switch 356, handle 430 and power cord may be made out of any durable material which at least partially insulates and protects the user from excess heat and/or electricity produced by the device. Such materials include, but are not limited to, plastics, silicones, vinyls, rubbers, boron, glass, wood and metals.

In one embodiment, the streamer chamber housing 270 may preferably be made of translucent material so as to allow the user to view the water level in the steam chamber 260. In another embodiment, the steamer chamber housing 270 may be entirely translucent, or consist of a translucent window to view the level of the contents of the steamer chamber 260. Materials suitable for making the steamer chamber housing include, but are not limited to, plastics, silicones, vinyls, rubbers, boron, fabrics, glass, wood and metals. In another embodiment the steam chamber housing 270 is a neck or collar made of a flexible material. In another embodiment the steam chamber housing 270 is made of an accordion-type material. In another embodiment, the steam chamber housing 270 can flex in any direction so as to concentrate and direct steam onto fabric.

In another embodiment the steamer chamber 260 is a neck or collar made of a flexible material. In another embodiment the steamer chamber 260 is made of an accordion-type material. In another embodiment, the steamer chamber 260 can flex in any direction so as to concentrate and direct steam onto fabric.

The steamer chamber 260 may also be made of a durable, translucent material. The steamer chamber 260, when collapsible, is made of a product durable enough to withstand collapsing and re-opening for storage, usage over a period of time and the high heat of the steam produced by the heating element 415 and gasket 417. Such material includes but is not limited to high temperature rubber/silicone. The steam chamber 260 may be a continuous or a corrugated chamber, which extends or expands with the collapsible handle upper section 436 and collapsible handle lower section 434.

The steam chamber 260 may expand to hold about 80% to 100% more water than comparable steamers. The lower chamber 400 is suitable for holding water.

In another embodiment, the steam chamber 260 may be locked in place by a locking mechanism. In one embodiment, the locking mechanism is a twistable lock. In all embodiments, the locking mechanism and the materials from which the steam chamber 260 and the steam chamber housing 270 prevent water from leaking out of the steamer 100. In another embodiment, the steamer will not operate unless the locking mechanism is engaged.

In another embodiment, the steam chamber housing 270 may be locked in place by a locking mechanism. In one embodiment, the locking mechanism is a twistable lock. In all embodiments, the locking mechanism and the materials from which the steam chamber 260 and the steam chamber housing 270 prevent water from leaking out of the steamer 100. In another embodiment, the steamer will not operate unless the locking mechanism is engaged.

In one embodiment, the locking mechanism for the steam chamber 260 and/or the steam chamber housing 270 utilizes an o-ring to assist in this water-tight lock mechanism.

In still another embodiment, the steam chamber 260 and/or the steam chamber housing 270 are the handle. In another embodiment, the steam chamber housing 270 is ergonomically designed to fit the shape of a human hand. In still another embodiment, the handle 430 or steam chamber housing 270 are covered with a material that prevents slippage from the hand.

In another embodiment, this steamer head 200 has an articulated crease panel 310 which, when not in use, rests flat against the face of the steamer head 200 (or steam outlet face 220) and allows the steamer head 200 to function normally to steam clothes. In another embodiment, when precise creasing is desired the crease panel 310 is engaged and a separation is created between the crease panel 310 and the steamer head 200 into which the garment to be creased is inserted. In another embodiment, the crease panel 310 is always under tension/load in its normal resting position and this same tension when activated is used to create the pressure necessary for the creasing function to be carried out. In another embodiment, the user may release the crease panel activation means 360 together with the crease panel activation means switch 365 during the actual creasing function for better control of the unit and less fatigue and strain on the hand/fingers from having to hold or press a mechanism to maintain the pressure needed to create a proper crease.

The power cord 460 provides for an electrical connection to an external power source allowing the heater 410, heating element 415 and gasket 417 to produce steam from water stored in the steam chamber 260, through the steamer body 210 and out the steamer holes 250. The heating element 415 is suitable for converting water to steam. One skilled in the art will appreciate that the steamer 100 may be powered internally with batteries, rechargeable batteries or some other portable power source such as a crank mechanism or solar power collectors. In another embodiment, the power cord 460 may be wound and stored in a concealed compartment, the power cord cavity 465. In another embodiment, the power cord 460 is attached to a retractable mechanism which hides the cord inside the power cord cavity 465.

Figure 3:
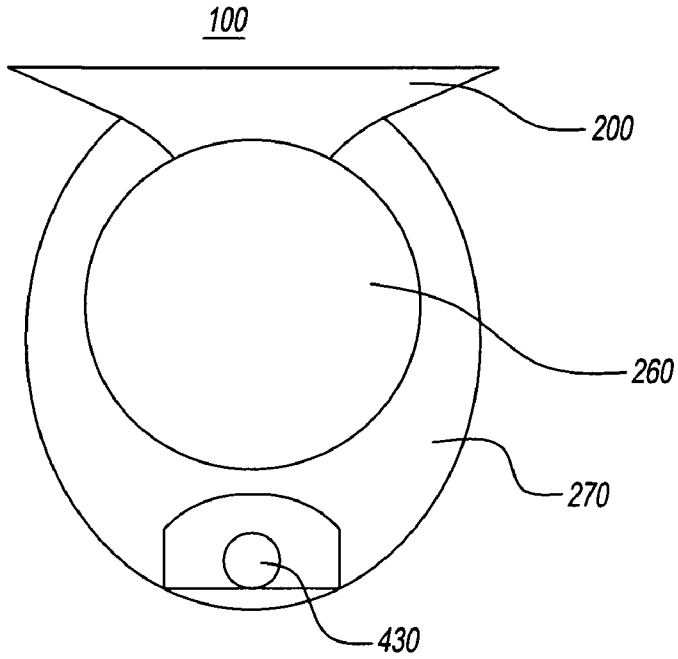
FIG. 3 is top view of the invention.

FIG. 3 is a top view of steamer 100, showing steamer head 200, steam chamber 260, steam chamber housing 270, handle 430. The steamer head 200 is suitable for dispensing steam.

Figure 4:
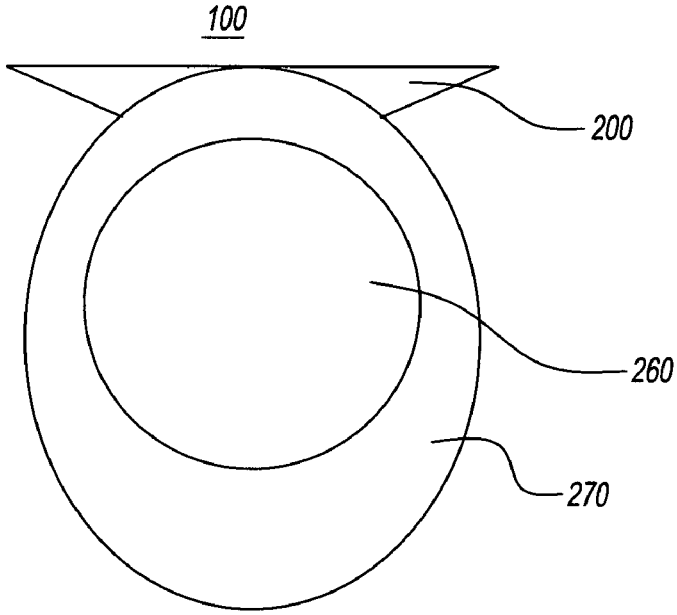
FIG. 4 is a bottom view of the invention.

FIG. 4 is a bottom view of steamer 100, showing steamer head 200, steam chamber 260, steam chamber housing 270.

Figure 5:
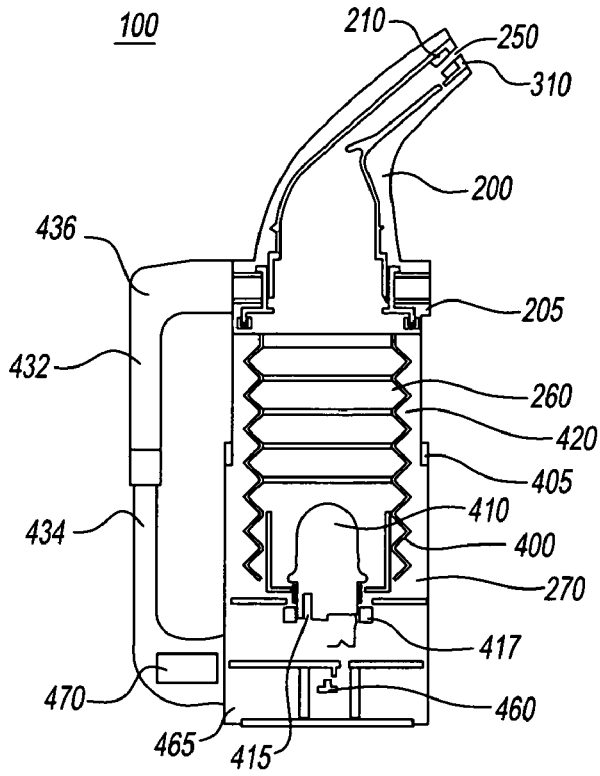
FIG. 5 is a side cut away view of an alternate embodiment of the invention.

FIG. 5 is a side cut away view of the embodiment of steamer 100 that includes a collapsible steam chamber. FIG. 5 shows steamer head 200, steamer head abutment 205, steamer body 210, steam hole 250, steam chamber 260, steam chamber housing 270, and crease panel 310.

In one embodiment, water is stored in the steam chamber 260 which is encased in the steam chamber housing, and steam produced in the steam chamber 260 moves through the steamer body 210, the steamer head 200 and out one or more steam holes 250.

In another embodiment, the steamer head 200 is one continuous piece. The steam head nozzle may consist of wings. In another embodiment, the steam head nozzle wings collapse for storage. In yet another embodiment, the inner walls of the steam head nozzle wings can be accordion type material or solid, or they may be fully or partially expanded. They may be made of materials such as plastics or other materials described herein. In all embodiments the retractable wings line up so that the steam hole or holes 250 permit the free flow of steam when in use.

In another embodiment, the steamer head 200 contains a lever to activate or to close the steam head 200. In another embodiment, the lever may be on the top or the bottom, or located anywhere on the steamer head. In another embodiment, the steamer head contains an apparatus which may also be one or more buttons or a sliding mechanism and which moves to open and close the steamer head 200. In still another embodiment, the level or button or device which activates or closes the steamer head 200 may lock in place.

In another embodiment, the steamer head 200 is a standalone module, compatible with other steamers.

In another embodiment, the steam chamber housing 270 may be one continuous piece. In another embodiment the steam chamber housing may be an accordion type material, or a collapsible plastic. The steamer head 200 and/or the steamer head abutment 205 may be tapered so that the upper portions are wider than the lower portions, thereby providing a larger surface area for steam to escape the steam hole or holes 250 and make contact with the fabric or item being steamed or creased. In another embodiment, the steamer head 200 and/or the steamer head abutment 205 may be tapered so that the upper portions are narrower than the lower portions, thereby providing a smaller surface area for steam to escape the steam hole or holes 250 and make contact with the fabric or item being steamed or creased.

In another embodiment, the steamer head 200 and/or the steamer head abutment 205 may be the same dimensions.

FIG. 5 also shows lower chamber 400, lower chamber abutment 405, heater 410, heating element 415, gasket 417, upper chamber 420, collapsible handle 432, collapsible handle lower section 434, collapsible handle upper section 436, power cord 460, power cord cavity 465, and power switch 470.

In one embodiment, the power switch 470 is activated by the user and a heater 410 heats the heating element 415 in the lower chamber 400.

In the embodiment illustrated in FIG. 8, the steamer contains a collapsible handle 432, which consists of collapsible handle lower section 436 and a collapsible handle upper section 434. The collapsible handle lower section 436 and a collapsible handle upper section 434 are made to slide over each other, which aids in transportability and in small storage spaces. In another embodiment, the handles are recessed or retracted, opening and closing between use and storage of the steamer 100. In another embodiment, the upper chamber 420 and lower chamber 400 move with the handles.

The upper chamber 420 and lower chamber 400 move independently of the collapsible handle 432. In another embodiment the upper chamber 420 slides into the lower chamber 400, being stopped by the lower chamber abutment 405. The upper chamber 420 may be movably connected to the lower chamber 400. The upper chamber 420 has a steamer head 200.

In another embodiment, the collapsible handle 432, retracts a recess in the steamer chamber housing 270 for storage. In another embodiment, the collapsible handle 432, when opened, reveals a window to allow the user to ascertain the water level in the steamer body 210. In another embodiment, the collapsible handle 432 in the fully opened position locks into the housing. In another embodiment, the collapsible handle 432 may be angled downward to facilitate grip and hand movement. On still another embodiment, the collapsible handle 432 is made of material which is a grip and which decreases the ability of the steamer to slip from the hand. In another embodiment, the gripping material partially covers the collapsible handle 432. In another embodiment, the gripping material covers entirely the collapsible handle 432.

In yet another embodiment, the open steamer 100 is about 100 mm to about 200 mm in height and shrinks to about 50 mm to about 150 mm in height when collapsed. These pieces may be made of any of the materials described herein or known to those in the art. One skilled in the art can ascertain appropriate dimensions for a useful steamer and its parts contained herein.

The power switch 470 permits the user to turn the steamer 100 on or off. The power switch may be located anywhere on the steamer. In one embodiment, the power switch 470 is located on or near the handle and activates the steamer 100 when contact is made so as to provide a safety on/off mechanism.

Figure 6:
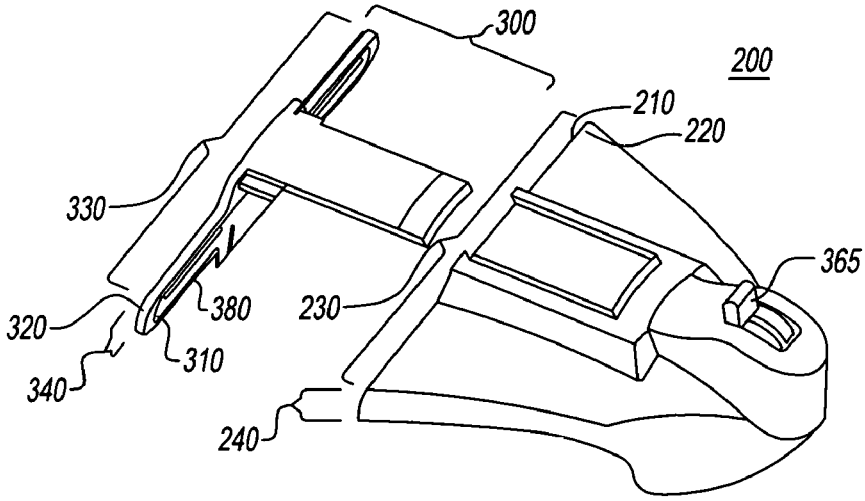
FIG. 6 is an exploded view of the steamer body.

FIG. 6 is an exploded view of the steamer head 200, showing steamer body 210, steamer body front face 220, steamer body front face length 230, steamer body front face width 240, crease panel assembly 300, crease panel 310, crease panel face 320, crease panel face length 330, crease panel face width 340, crease panel activation means switch 365, and crease panel roller 380.

Figure 7:
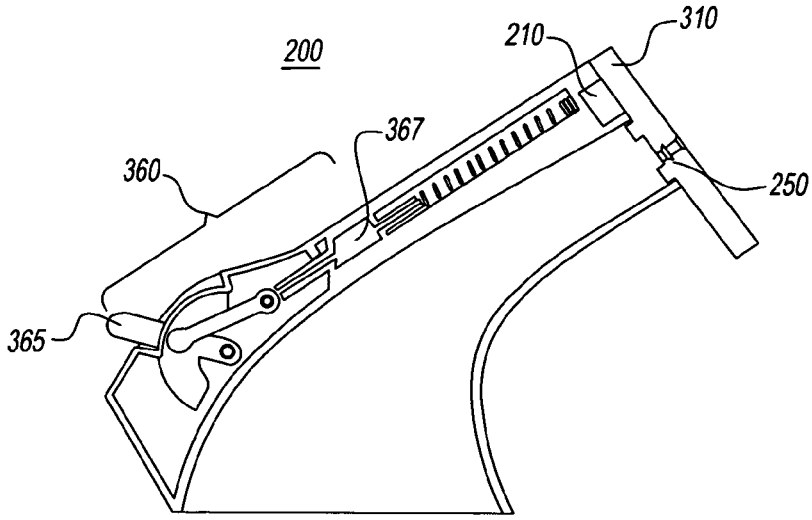
FIG. 7 is an exploded view of the creasing mechanism.

FIG. 7 is an exploded view of the crease activation system and shows steamer head 200, steamer body 210, steam hole 250, crease panel 310, crease panel activation means 360, crease panel activation means switch 365, crease panel activation means lever 367, crease panel activation means spring 370.

The user may activate the crease activation system as described above by moving the crease panel activation means switch 365, which in turn moves the crease plate 310 via the crease panel activation means lever 367, which is spring loaded, by the crease panel activation means spring 370.

Figure 8A:
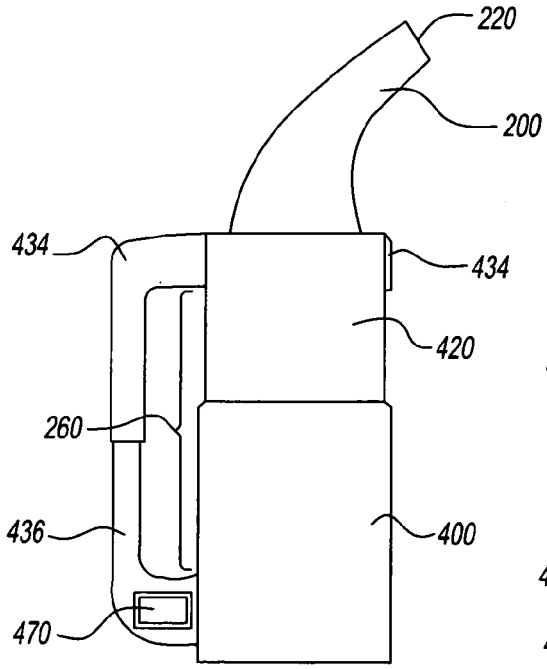
FIG. 8 is side view of an alternate embodiment of the invention.
Figure 8B:
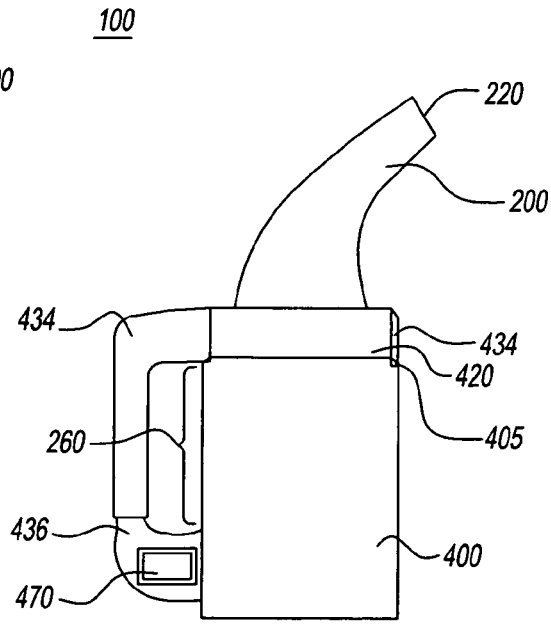

FIG. 8*a* and FIG. 8*b* illustrate the collapsible nature of the steamer body. FIG. 8*a* & FIG. 8*b* show the embodiment of steamer 100 with a collapsible steam chamber 260, steamer head 200, steamer body front face 220, lower chamber 400, upper chamber 420, collapsible handle upper section 434, collapsible handle lower section 436, power switch 470. FIG. 8*b* shows lower chamber abutment 405. The lower chamber abutment 405 stops the upper chamber 420 from moving at a certain point when the user slides upper chamber 420 over lower chamber 400 to collapse the steamer.

In the embodiment that allows for world voltage use the present invention has a built in step-up or step-down transformer which is user selectable for either 110-120 volt input or 220-240 volt input depending on the country and electricity standard used. Another embodiment includes electronic parts and circuitry that is already designed to handle a range of input voltages, for example, voltages ranging from 110 volts up to 240 volts.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed:

1. A steamer, comprising:

a lower chamber suitable for containing water;

a heating element suitable for converting the water to steam;

an upper chamber being telescopically movably connected to the lower chamber, and the upper chamber having a steamer head suitable for dispensing steam; and a collapsible membrane disposed between the lower and upper chamber, said collapsible membrane being totally enclosed within said upper and lower chambers when in use and being attached at a top end to said upper chamber and at a bottom end to the lower chamber such that said collapsible membrane is constrained to collapse substantially along a vertical axis of said collapsible membrane and said collapsible membrane being sized such that when in a collapsed configuration, an outer diameter of said collapsible membrane is substantially the largest diameter circle containable by said chambers.

2. The steamer of claim 1, wherein the steamer has a handle.

3. The steamer of claim 2, wherein the handle is collapsible.

4. The steamer of claim 1, wherein the steamer head has a foldable nozzle.

5. The steamer of claim 1, wherein the heating element has a cord and the cord can be stored in the lower chamber.

6. The steamer of claim 1, wherein steamer has a power switch which actives the heating element.

* * * * *